US006474563B2

(12) United States Patent
Pletcher et al.

(10) Patent No.: US 6,474,563 B2
(45) Date of Patent: Nov. 5, 2002

(54) SPRAYING DEVICE FOR DISPENSING HOME CARE FORMULATIONS WITH ELECTROSTATIC LIQUID DROPLETS

(75) Inventors: Timothy Allen Pletcher, Eastampton, NJ (US); Peter John Zanzucchi, West Windsor, NJ (US); Robert Richard Demers, Cranbury, NJ (US); Howard Christopher Rivenburg, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/794,441

(22) Filed: Feb. 27, 2001

(65) Prior Publication Data

US 2001/0052551 A1 Dec. 20, 2001

Related U.S. Application Data

(60) Provisional application No. 60/201,502, filed on May 3, 2000.

(51) Int. Cl.[7] ..... B05B 5/025

(52) U.S. Cl. ..... 239/3; 239/337; 239/690; 239/690.1; 239/706; 239/708; 222/402.1; 222/402.25

(58) Field of Search ..... 239/3, 337, 690, 239/690.1, 706, 708; 222/402.1, 402.25

(56) References Cited

U.S. PATENT DOCUMENTS 4,634,057 A * 1/1987 Coffee et al. ..... 239/690
4,971,257 A * 11/1990 Birge ..... 239/708
5,316,221 A * 5/1994 Glover et al. ..... 239/708
5,490,633 A * 2/1996 Jeffries et al. ..... 239/708
5,538,190 A * 7/1996 Greene et al. ..... 239/331
6,079,634 A * 6/2000 Noakes et al. ..... 239/690

FOREIGN PATENT DOCUMENTS

| | | |
|---|---|---|
| WO | WO 97/28883 | 8/1997 |
| WO | WO 99/01227 | 1/1999 |
| WO | WO 00/01421 | 1/2000 |
| WO | WO 00/01422 | 1/2000 |
| WO | WO 00/01423 | 1/2000 |
| WO | WO 00/01429 | 1/2000 |
| WO | WO 00/01493 | 1/2000 |
| WO | WO 00/1494 | 1/2000 |

* cited by examiner

*Primary Examiner*—Robin O. Evans
(74) *Attorney, Agent, or Firm*—William J. Burke

(57) ABSTRACT

A spraying device for dispensing electrostatic liquid droplets includes a container holding a liquid at one end, and having a nozzle assembly with an aperture at another end. The nozzle assembly includes a longitudinal hollow tube terminating in a metallic structure. The metallic structure includes a metallic base plate having at least one aperture formed therein for fluid communication with the hollow tube. The longitudinal hollow tube includes an end inserted in the liquid. A charge accumulator disposed in the liquid accumulates electrostatic charges. A wire conductor between the base plate and the charge accumulator transfers the electrostatic charges from the liquid to the nozzle assembly.

21 Claims, 3 Drawing Sheets

SPRAYING DEVICE FOR DISPENSING HOME CARE FORMULATIONS WITH ELECTROSTATIC LIQUID DROPLETS

CROSS-REFERENCE TO RELATED APPLICATIONS

This application claims the benefit of U.S. Provisional Application No. 60/201,502, filed May 3, 2000, the contents of which are incorporated herein by reference.

TECHNICAL FIELD

The present invention relates, in general, to a method and apparatus for dispensing of home care liquid formulations and, more specifically, to a method and apparatus for inducing electric charge onto the home care formulations upon dispensing from the spraying device.

BACKGROUND OF THE INVENTION

The efficacy of home care liquid formulation sprays depends, in part, upon the distribution of the formulation and how efficiently it contacts the intended target surface. Aerosol sprays may be dispersed into volumes or onto areas as desired. When this is done, however, various air disturbances may prevent droplets from reaching the intended target material or from sufficiently reaching all of the desired surface area.

The probability of droplets reaching their target(s) may be increased, if the droplets are electrically charged. By electrically charging the droplets, the target materials or target areas, which are at a different electrical potential, form an attraction with the droplets. This improves the efficacy of the formulation.

Spraying apparatus for producing a spray of liquid droplets is well known. For example, such apparatus is known in the domestic environment for producing sprays of droplets of liquid home care products. Generally, such apparatus includes a reservoir for accommodating the liquid composition to be sprayed, a spraying head including a bore through which the composition is expelled in the form of a spray of droplets, and a conduit system whereby the composition may pass from the reservoir to the spraying head. The apparatus may be in the form of an aerosol, in which case it includes gas under pressure, which expels the liquid composition from the reservoir to the spraying head and then out of the spraying head in the form of a spray of droplets.

Generally, the droplets leaving the spraying head have a small electrostatic charge created by electron transfer between the liquid and the walls of the apparatus. It is known that it is necessary to increase the level of charge on the droplets significantly to enable electrostatic attraction to insects.

It is also known that components of the apparatus in contact with the liquid have the ability to influence the charge given to the liquid as it is being sprayed. More particularly, it has been found that the charge on the droplets increases with an increase in contact area between the liquid and the bore-defining portions of the spraying head.

One specific home care product application is insecticides. International Publication Number WO099/01227 discloses a method of killing flying insects using electrostatically charged droplets of an insecticidal formulation having a charge-to-mass ratio of approximately $\pm 1\times 10^{-4}$ Coulombs/kilogram (C/kg). The charge is imported to the liquid droplets by double layer charging. The charge is dispersed as the liquid is aerosolized.

Various characteristics of an aerosol spray device may increase double layer charging and charge exchange between the liquid formulation and the surfaces of the components of the aerosol spray device. Such increases may be brought about by factors increasing the turbulence of the flow through the device, and increasing the frequency and velocity of contact between the liquid and the internal surfaces of the container, valve and actuator.

A need still exists for a spraying device that dispenses electrostatic liquid droplets by methods that develop charging of a liquid formulation. A need also exists for dispensing the electrostatic liquid droplets from a standard domestic aerosol can using a method that reliably and robustly induces a charge of desired polarity on the formulation as it is sprayed.

SUMMARY OF THE INVENTION

To meet this and other needs, and in view of its purposes, the present invention provides a spraying device for dispensing electrostatic liquid droplets. The device includes a container holding a liquid at one end, and having a nozzle assembly with an aperture at another end. The nozzle assembly includes a longitudinal hollow tube terminating in a metallic structure. The structure includes a metallic base plate having at least one aperture formed therein. The longitudinal hollow tube is inserted in the aperture for fluid communication with the liquid. A charge accumulator disposed in the liquid accumulates electrostatic charges. A wire conductor between the base plate and the charge accumulator transfers the electrostatic charges from the liquid to the nozzle assembly.

In one embodiment, the charge accumulator includes first and second opposing surfaces separated by a space, the space containing polymer beads and liquid. The first and second surfaces are each formed from a material selected from one end of the Triboelectric Series and the polymer beads are formed from another material selected from another end of the Triboelectric Series. A metallic wire mesh is included in the second surface. When shaking the container, the polymer beads move against the opposing surfaces and the electrostatic charges are accumulated on the metallic wire mesh.

In another embodiment, the charge accumulator includes a flywheel oriented to intercept a liquid stream flowing into the longitudinal hollow tube. A voltage generator is engagingly coupled by a shaft to the flywheel and provides electrostatic charges when the flywheel rotates by pressure from the liquid stream flowing to the nozzle. A conductor wire between the voltage generator and the nozzle brings the charges to the droplets as they are being sprayed out of the container.

It is understood that the foregoing general description and the following detailed description are exemplary, but are not restrictive, of the invention.

BRIEF DESCRIPTION OF THE DRAWINGS

The invention is best understood from the following detailed description when read in connection with the accompanying drawing. Included in the drawing are the following figures.

DETAILED DESCRIPTION OF THE INVENTION

Figure 1:
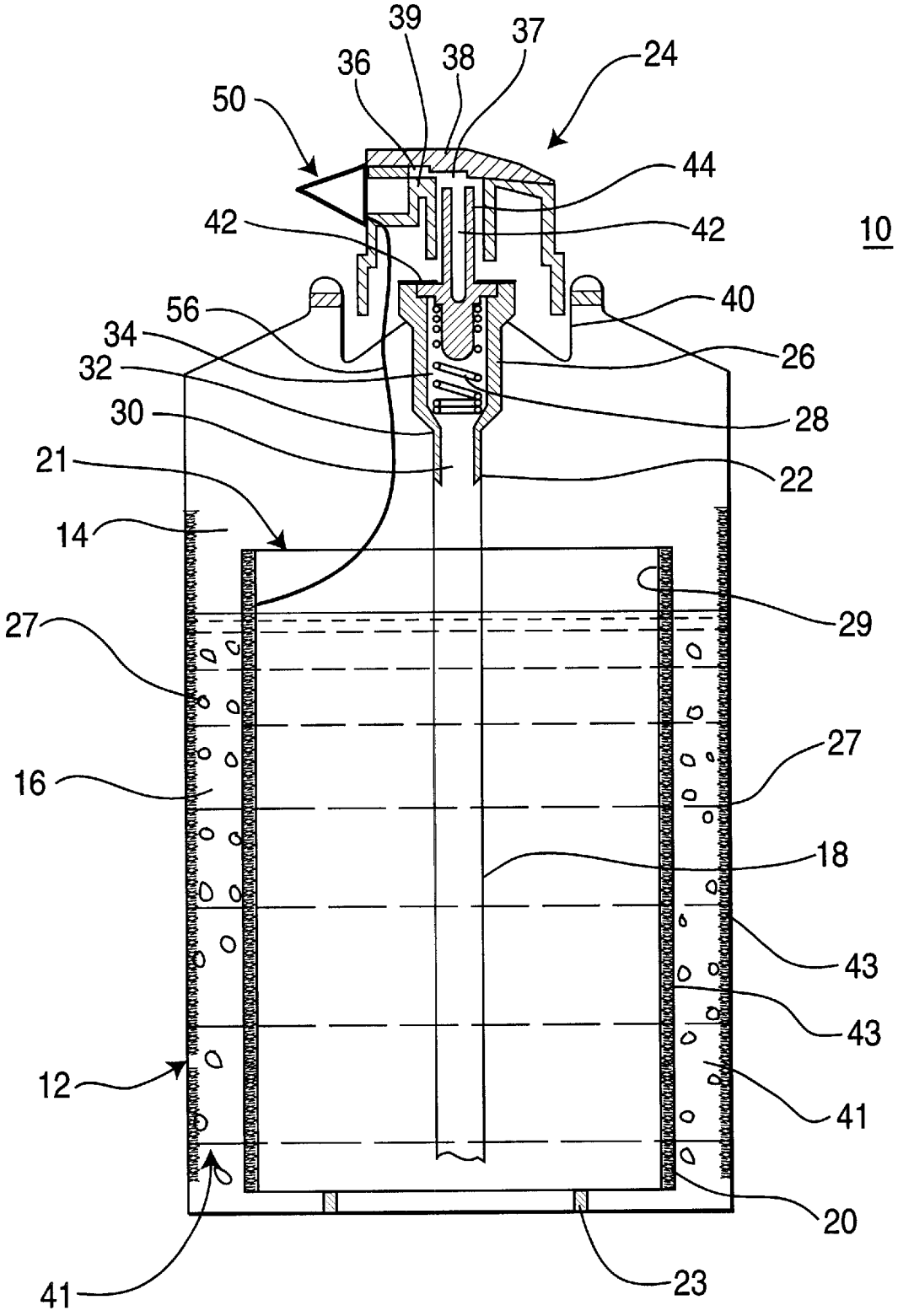
FIG. 1 is a diagrammatic cross section through an aerosol spray device embodying a tribo-shaking approach to charging a liquid spray.
Figure 2:
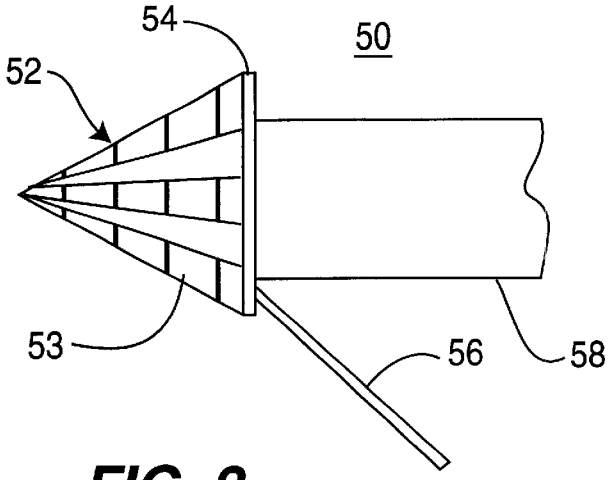
FIG. 2 is a schematic side view of a nozzle assembly inserted in the aerosol spray device of FIG. 1.
Figure 3:
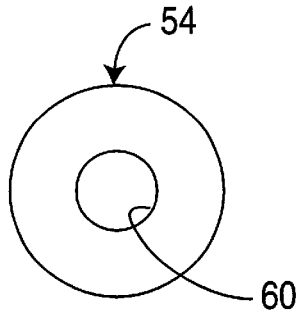
FIGS. 3 and 4 show base plates having different apertures, each forming a base of a nozzle assembly in accordance with an embodiment of the invention.

Referring to FIGS. 1–3, there is shown a spraying device in accordance with the invention. The spraying device, generally designated as 10, includes container 12 and head assembly 24 secured together by mounting assembly 40. Container 12 may be formed of aluminum or tin plate, or the like, in conventional manner. Container 12 includes reservoir 14 holding liquid 16 and a gas under pressure which is capable of forcing the liquid out of the container via a conduit system. The conduit system includes dip tube 18 terminating at a bottom portion of the container and another end 22 connecting to tail piece 26 of head assembly 24. The tail piece is secured by mounting assembly 40 into an opening in the top of the container and includes lower portion 32 defining tail piece orifice 30 to which end 22 of dip tube 18 is connected. The tail piece includes bore 34 of relatively narrow diameter at lower portion 32 and a relatively wider diameter at its upper portion. The valve assembly also includes stem pipe 44 mounted within bore 34 of the tail piece and arranged to be axially displaced within bore 34 against the action of spring 28. Stem pipe 44 includes internal bore 42 having one or more lateral openings (not shown).

Figure 4:
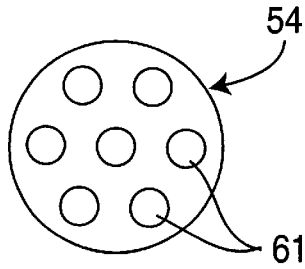

The head assembly includes actuator 38 having central bore 37 which accommodates stem pipe 44 such that internal bore 42 is in communication with central bore 37 of the actuator. Passage 36 in the actuator extending perpendicularly to central bore 37 links the central bore with a recess including post 39 on which is mounted nozzle assembly 50. Nozzle assembly 50, described in detail later, includes aperture 60 (FIGS. 3 and 4) in communication with passage 36.

Ring 42 of elastomeric material is provided around the outer surface of stem pipe 44 and, ordinarily, this sealing ring closes the opening between central bore 37 and bore 34. The construction of head assembly 24 is such that when actuator 38 is manually depressed, stem pipe 44 is urged downwardly against the action of spring 28, so that sealing ring 42 no longer closes the lateral opening. In this disposition, a path is provided from reservoir 14 to aperture 60 of nozzle assembly 50. In this manner, liquid may be forced, under pressure of gas in the container, to nozzle assembly 50 via the conduit system.

It will be appreciated that the invention is not limited to the conduit system and the head assembly shown in FIG. 1. Those skilled in the art will appreciate that other methods are known of forcing liquid from a container through an orifice in a head assembly.

Referring now to FIG. 2, nozzle assembly 50 is shown in greater detail. As shown, nozzle assembly 50 includes a longitudinal hollow tube, designated as 58. One end of the hollow tube is in communication, via the conduit system, with the liquid in container 12. The other end of longitudinal hollow tube 58 terminates in a metallic conical structure, designated as 52. The metallic conical structure is formed by metallic plate 54 disposed at the base of the conical structure. Metallic screen mesh 53 forms the conical portion of structure 52, tapering from base plate 54 at one end toward a tip formed at the apex of the conical structure, at the other end. The base plate has a diameter of approximately 3 mm to 4 mm.

At least one aperture is centrally formed in base plate 54, designated as 60 in FIG. 3. Aperture 60 has a maximum diameter of approximately 0.5 mm. Base plate 54 may also contain several apertures. In the embodiment shown in FIG. 4, base plate 54 includes multiple apertures 61 symmetrically located in the plate. Each aperture 61 has a maximum diameter of approximately 0.2 mm.

Wire conductor 56 is connected at one end to base plate 54, as shown in FIG. 2. The other end of wire conductor 56 is connected to charge accumulator 21 shown in FIG. 1.

In other embodiments, the nozzle insert may be of a shape other than a conical structure. For example, the nozzle insert may be cylindrical in structure having a single aperture or multiple apertures. The nozzle insert may of a type conventionally used in spraying devices. The nozzle insert may also have interior fins that aid in dispersion of the spray.

In the embodiments of nozzle inserts, each insert has radial symmetry and includes a metallic portion. Each insert also includes a conductor attached to the metallic portion, so that the metallic portion may be charged via the conductor. The maximum diameter of the nozzle insert is 3 mm to 4 mm. The diameter of the aperture for the passage of liquid is approximately 0.5 mm for single aperture structures. For multiple aperture structures the maximum diameter of any aperture is 0.2 mm.

Charge accumulator 21 includes inner cylindrical container 29 positioned within container 12. Inner container 29 includes cylindrical wall 20 having wire mesh conductors embedded therein. Inner container 29 is electrically isolated from outer container 12. In the embodiment shown in FIG. 1, inner container 29 is anchored to outer container 12 by way of insulated posts 23. Other methods may also be used to position and electrically isolate inner container 29 within outer container 12.

Space 41 is formed between an outer surface of inner container 29 and an interior surface of outer container 12. The space is large enough so that polymer beads 27, each having a minimum diameter of 200 microns, may move freely up or down space 21, when container 12 is shaken. The space is also sufficiently narrow so that the polymer beads may bounce against the opposing surfaces, when the container is shaken.

The opposing surfaces forming space 41 are lined with, or made from a material at one end of the Triboelectric Series. The lined material, generally designated by 43, may be window glass, for example. The polymer beads are lined with, or made from a material at another end of the Triboelectric Series. The material from the other end of the Triboelectric Series may be, for example, polyethylene.

When the two dissimilar materials in the Triboelectric Series move against each other, charges transfer from one material to the other. The charges accumulate as electrostatic charges. These electrostatic charges are accumulated on the opposing surfaces when the container is physically shaken by the user. Conductors embedded in the cylindrical wall of inner container 29 conduct the accumulated charges by way of wire conductor 56 to the nozzle assembly. Charges are then transferred to the droplets as they flow through plate 54 and through the metallic conical tip.

TABLE 1

| Triboelectric Series | |
|---|---|
| Most Positive | |
| ↑ | Silicon elastomer with silica filler |
| | Borosilicate glass, fire polished |
| | Window glass |
| | Aniline - formol resin (acid catalyzed) |
| | Polyformaldehyde |
| | Poly (methyl methacrylate) |
| | Ethyl cellulose |
| | Polyamide II |
| | Polyamide 6-6 |
| | Rock salt, NaCl |
| | Melamine formol |
| | Wool, knitted |
| | Silica, fire-polished |
| | Silk, woven |
| | Poly (ethylene glycol succinate) |
| | Cellulose acetate |
| | Poly (ethylene glycol adipate) |
| | Poly (diallyl phthalate) |
| | Cellulose (regenerated) sponge |
| | Cotton, woven |
| | Polyurethane elastomer |
| | Styrene - acrylonitrile copolymer |
| | Styrene - butadiene copolymer |
| | Polystyrene |
| | Polyisobutylene |
| | Polyurethane flexible sponge |
| | Borosilicate glass, ground surface |
| | Poly (ethylene glycol terephthalate) |
| | Polyvinylbutyral |
| | Formo-phenolique, hardened epoxide resin |
| | Polychlorobutadiene |
| | Butadiene-acrylonitrile copolymer |
| | Natural rubber |
| | Polyacrylonitrile |
| | Sulfur |
| | Polyethylene |
| | Poly (diphenylol propane carbonate) |
| | Chlorinated Polyester |
| | Poly (vinyl chloride) with 25% D.O.P. |
| | Poly (vinyl chloride) without plasticizer |
| | Polytrifluorochlorethylene |
| ↓ | Polytetrafluoroethylene |
| Most Negative | |

Figure 5:
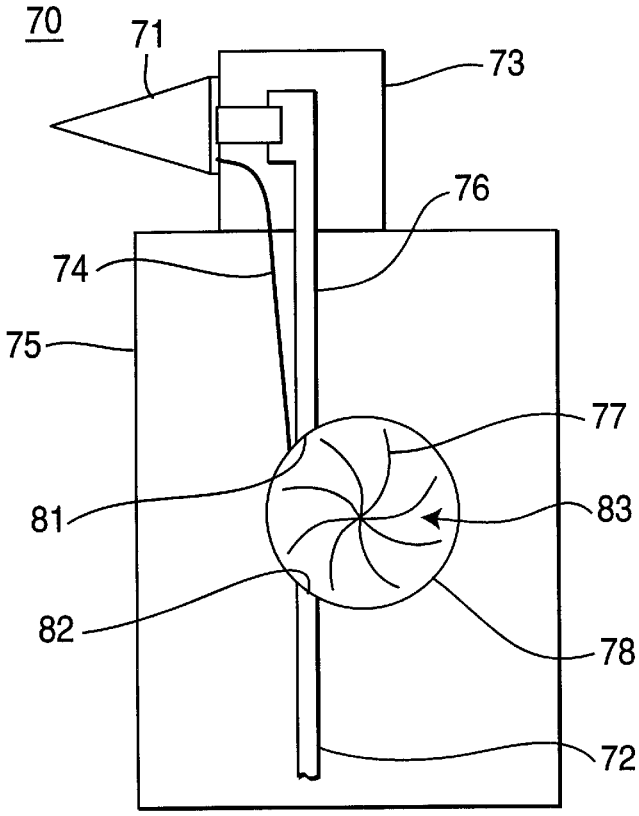
FIG. 5 is a diagrammatic cross section through a spraying device embodying a turbine generator providing an inductive approach to charging a liquid spray.
Figure 6:
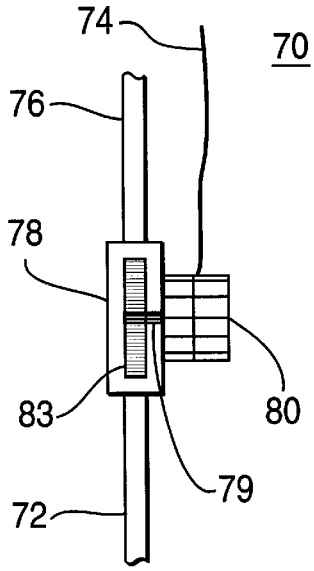
FIG. 6 is a schematic side view of part of the spraying device of FIG. 5 illustrating the turbine generator.

Another embodiment of the invention is shown in FIGS. 5 and 6. As shown, spraying device 70 includes container 75 holding a liquid and head assembly 73. Although not shown in FIG. 5, it will be appreciated that head assembly 73 may be mounted on container 75 in a manner similar to spraying device 10 shown in FIG. 1. Spraying device 70 also includes nozzle assembly 71, which may be similar to nozzle assembly 50 shown in FIG. 1. The conduit system for fluid communication between the container and nozzle assembly is shown in FIG. 5. Although shown without an actuator and valve, it may be understood that the conduit system may be similar to the conduit system described in FIG. 1.

Spraying device 70 generates a charge within container 75 using a turbine generator. As shown, the charge accumulator of spraying device 70 includes flywheel 83 engagingly coupled by shaft 79 to voltage generator 80. The voltage generated by generator 80 is provided from an output terminal via wire conductor 74 to nozzle assembly 71. Although not shown, the other output terminal of generator 80 may be grounded to container 75.

Flywheel 83 is axially mounted at a radial center of cylindrical housing 78 and includes propeller-like vanes 77. Housing 78 may be anchored to the walls of container 75 by electrically isolated posts (not shown). Housing 78 includes lower opening 82 for receiving the liquid stream, via lower tube 72, when liquid dispensing is actuated by head assembly 73. Upper opening 81 is provided in housing 78 for fluid communication between housing 78 and nozzle assembly 71, via longitudinal hollow tube 76. Lower opening 82 and upper opening 81 direct the liquid stream in transverse and off-center directions to the axis of flywheel 83. In this manner, the liquid stream flowing from lower tube 72 toward longitudinal hollow tube 76 rotates the propeller-like vanes of the flywheel.

In operation, when head assembly 73 actuates dispensing of liquid, the flow stream moving from tube 72 into the entrant end of longitudinal hollow tube 76 rotates the propeller-like vanes of the flywheel. In turn, voltage generator 80 is rotated, by way of shaft 79, and produces electrostatic charges, which migrate to conductive nozzle assembly 71 via wire conductor 74. The electrostatic charges are then transferred to the liquid droplets, as they are dispensed from nozzle assembly 71.

It will be appreciated that the energy for rotating the flywheel may be produced by pressure from a gas upon the liquid in container 75, as in an aerosol spray can or a mechanically hand-pumped container.

Figure 7:
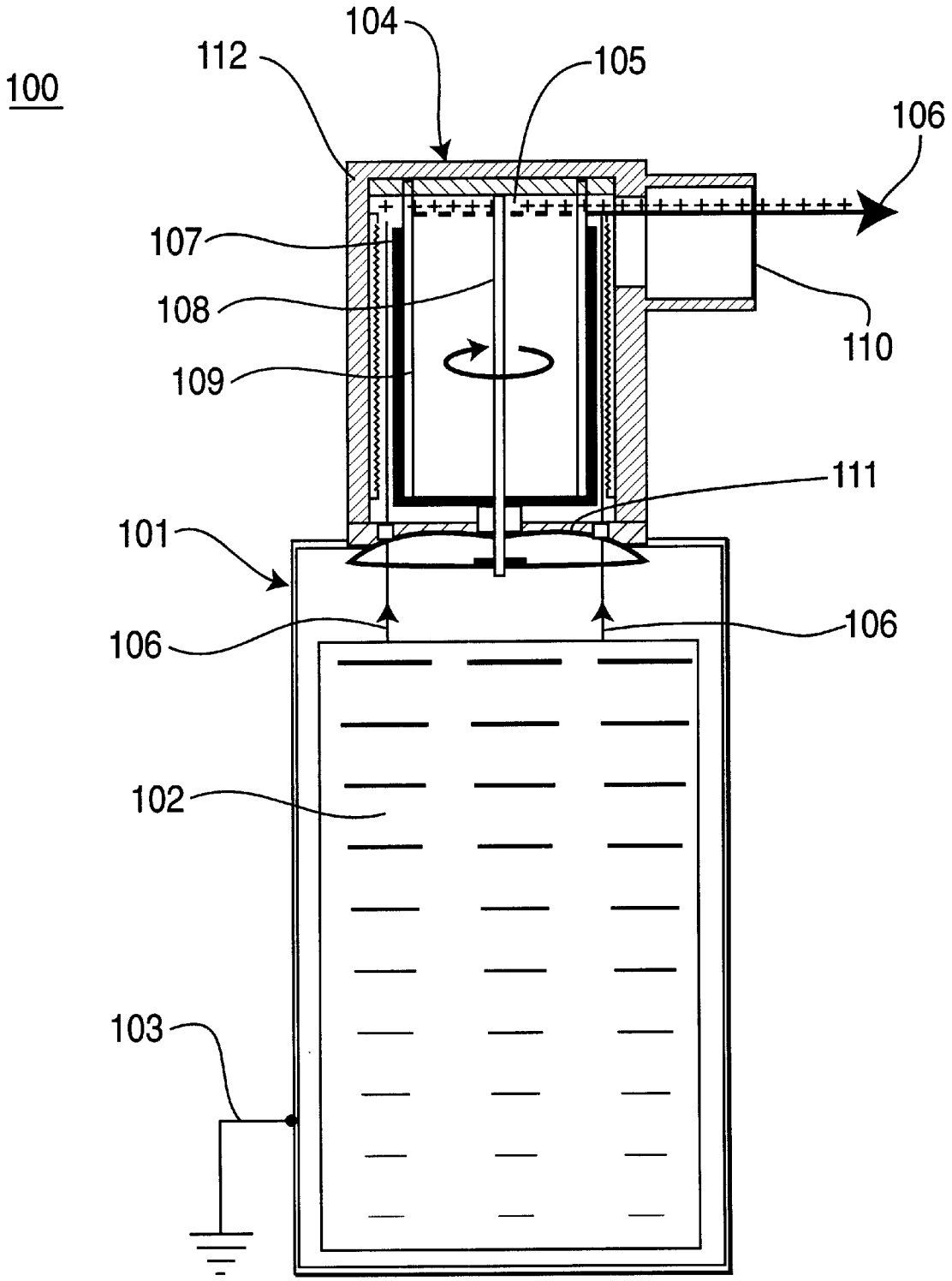
FIG. 7 is a diagrammatic cross section through a spraying device embodying a pseudo-Van de Graph generator for charging a liquid spray.

Another embodiment of the invention is shown in FIG. 7, depicting spraying device 100. The spraying device includes cylindrical head 104 positioned on top of container 101. Nozzle head 110 is inserted in cylindrical head 104. For ease of explanation, the actuator and valve assembly have been omitted from FIG. 7.

Electrostatic charging of flow stream 106, as it moves from reservoir 102 toward nozzle head 110, is accomplished by a pseudo-Van de Graph generator fitted inside cylindrical head 104. As shown, cylindrical drum 107 is concentrically fitted within the cylindrical head and is axially mounted for rotation on a top portion of longitudinal shaft 108. Rotor 111 is axially mounted on a bottom portion of longitudinal shaft 108. The blades of rotor 111 are configured to intercept flow stream 106, as it flows from container 101 toward nozzle head 110.

Cylindrical drum 107 includes an interior longitudinal surface formed from a material selected from one end of the Triboelectric Series (Table 1). A longitudinal sleeve, generally designated 109, is formed from a material selected from another end of the Triboelectric Series. The longitudinal sleeve is aligned to rub against the interior longitudinal surface of cylindrical drum 107.

Container 101 may be electrically grounded by way of a user's fingers holding the container, as shown by ground reference 103. The container may be electrically isolated from cylindrical head 104 by forming the walls of the cylindrical head from dielectric material 112.

In operation, the resulting tribocharging of the two rubbing surfaces induces charge migration in the rotating cylinder material. Charges of opposite polarity appear on the outer surfaces. The liquid as it passes the blades of the rotor, flows around the outside of the rotating cylinder. The liquid then becomes inductively charged as it picks up the transferred charges from the rotating cylinder. Because this embodiment has a greater surface area for transferring charge, it imparts a higher charge to the passing liquid. The charged liquid flows up between the inner surface of cylindrical head 104 and the outer surface of cylindrical drum 107. The charged liquid is directed in a transverse direction through passageway 105 and is then sprayed out from nozzle head 110.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A spraying device for dispensing electrostatically charged liquid droplets comprising:

a container holding a liquid at one end and having an aperture at another end;

a nozzle assembly including (a) a longitudinal hollow tube terminating in a metallic structure, (b) the metallic structure including at least one aperture formed therein for fluid communication with the hollow tube; and (c) a wire conductor having an end connected to the metallic structure;

the longitudinal hollow tube inserted in the aperture of the container for fluid communication with the liquid;

a charge accumulator disposed in the liquid for accumulating electrostatic charges; and the wire conductor having another end connected to the charge accumulator;

wherein the wire conductor transfers the electrostatic charges to the metallic structure and the liquid, when dispensed as droplets by the nozzle, receives the electrostatic charges.

2. The spraying device of claim 1 wherein the metallic structure includes a circular base plate and a plurality of apertures arranged in radial symmetry for fluid communication with the hollow tube.

3. The spraying device of claim 2 wherein the base plate has a diameter ranging from 3 mm to 4 mm and each of the apertures has a diameter of 0.5 mm maximum.

4. The spraying device of claim 1 wherein the charge accumulator includes:

first and second opposing surfaces separated by a space, the space containing polymer beads and the liquid, and the second surface formed from a metallic wire mesh;

wherein when shaking the container, the polymer beads move against the opposing surfaces and the electrostatic charges are accumulated on the metallic wire mesh.

5. The spraying device of claim 4 wherein the other end of the wire conductor is connected to the metallic wire mesh by a capacitor.

6. The spraying device of claim 4 wherein the first surface is formed by an interior wall of the container, and the second surface is concentrically spaced from the first surface; and the first and second surfaces are each formed from a material selected from one end of the Triboelectric Series and the polymer beads are formed from another material selected from another end of the Triboelectric Series.

7. The spraying device of claim 6 wherein each of the polymer beads has a diameter of at least 200 microns, and the space between the first and second surfaces permits the polymer beads to move freely between the surfaces when the container is shaken.

8. The spraying device of claim 1 wherein the charge accumulator includes:

a flywheel oriented to intercept a liquid stream flowing into an entrant end of the longitudinal hollow tube; and a voltage generator engagingly coupled by a shaft to the flywheel and providing the electrostatic charges to the wire conductor;

wherein when the liquid stream is flowing, the flywheel rotates and turns the voltage generator to provide the electrostatic charges.

9. The spraying device of claim 8 wherein the flywheel is axially mounted at a radial center of a cylindrical wall and includes propeller-like vanes, the cylindrical wall having a first opening for fluid communication with the entrant end of the longitudinal hollow tube, and a second opening for receiving the flowing liquid stream, the first and second openings oriented to direct the liquid stream in a transverse direction to the axis of the flywheel for rotating the propeller-like vanes.

10. The spraying device of claim 1 wherein the liquid is a home care product composition.

11. The spraying device of claim 10 wherein the liquid includes one of a slurry composition and a emulsion.

12. The spraying device of claim 1 wherein the liquid is sprayed from an aerosol container and is mechanically operated under pressure.

13. The spraying device of claim 1 wherein the liquid is an insecticidal composition.

14. The spraying device of claim 1 wherein the metallic structure provides a metallic circular base plate at one end and a conical taper forming a tip at another end; and the at least one aperture is provided in the base plate.

15. The spraying device of claim 14 wherein the end of the wire conductor is connected to the base plate.

16. The spraying device of claim 14 wherein the conical taper is provided by a metallic screen.

17. A method for dispensing electrostatically charged liquid droplets from a nozzle of a spraying device, comprising the steps of:

(a) mechanically generating charges in a charge accumulator of the spraying device;

(b) transferring the charges from the charge accumulator to the nozzle; and (c) transferring the charges from the nozzle to the liquid droplets, as the liquid droplets are dispensed from the spraying device.

18. The method of claim 17 wherein step (a) includes:

forcing liquid to flow in a container through a path;

rotating a flywheel in the flowing path of the liquid;

rotating a voltage generator when rotating the flywheel; and accumulating the charges in the voltage generator.

19. The method of claim 17 wherein step (a) includes:

forming the charges in a space between opposing surfaces, the opposing surfaces defined by the spraying device and an interior cylinder placed within the spraying device; and accumulating the charges on the interior cylinder.

20. The method of claim 19 wherein the charges are formed by bouncing polymer beads between the opposing surfaces.

21. The method of claim 19 wherein the charges are accumulated by a metallic wire mesh on the interior cylinder.

* * * * *